United States Patent [19]

Herdman

[11] Patent Number: 4,715,094

[45] Date of Patent: Dec. 29, 1987

[54] SHOE LACE KNOT RETAINER

[76] Inventor: Charles W. Herdman, 1253 Stirling Rd., Dania, Fla. 33004

[21] Appl. No.: 869,990

[22] Filed: Jun. 3, 1986

[51] Int. Cl.[4] ..... F16G 11/00

[52] U.S. Cl. ..... 24/119; 24/117; 24/120

[58] Field of Search ..... 24/119, 117 R, 118, 24/120, 128; 36/50

[56] References Cited

U.S. PATENT DOCUMENTS

| | | | |
|---|---|---|---|
| 569,398 | 10/1896 | Augensen | 24/119 |
| 574,484 | 1/1897 | Johnson | 24/119 |
| 592,140 | 10/1897 | Gross | 24/117 R |
| 657,606 | 9/1900 | Lee | 24/119 |
| 722,891 | 3/1903 | Pitman | 24/117 R |
| 1,249,461 | 12/1917 | Niell | 24/120 |
| 3,057,029 | 10/1962 | Miller, Jr. et al. | 24/120 |
| 3,106,003 | 10/1963 | Herdman | 24/119 |
| 3,122,805 | 3/1964 | Hakim | 24/119 |
| 3,132,394 | 5/1964 | Russell | 24/119 |
| 3,229,340 | 1/1966 | Herdman | 24/119 |
| 3,290,745 | 12/1966 | Maxwell et al. | 24/120 |
| 3,418,733 | 12/1968 | Tyrrell, Sr. et al. | 24/117 R |
| 3,473,198 | 10/1969 | Meier | 24/119 |
| 3,908,238 | 9/1975 | Panicci | 24/119 |
| 4,049,357 | 9/1977 | Hamisch, Jr. | 24/128 |

FOREIGN PATENT DOCUMENTS

| | | | |
|---|---|---|---|
| 2004575 | 8/1970 | Fed. Rep. of Germany | 24/119 |

*Primary Examiner*—Victor N. Sakran

*Attorney, Agent, or Firm*—Berman, Aisenberg & Platt

[57] ABSTRACT

A shoelace knot retainer comprises top and bottom portions which are preferably hinged together. The bottom portion includes parallel side walls spaced by an opening which receives the shoelaces. The top portion includes ribs which lie adjacent the side walls when the top is engaged over the bottom. When the retainer is placed over a knot such that the knot is received between the side walls, the ends of the shoelace and the tips of the bow lie over the side walls and are clamped by the ribs when the top is engaged over the bottom. In a preferred embodiment, the ribs and the sidewalls have serrated edges to assist in gripping the shoelace.

19 Claims, 4 Drawing Figures

SHOE LACE KNOT RETAINER

FIELD OF THE INVENTION

This invention concerns a shoelace knot retainer which prevents shoelaces from becoming untied.

BACKGROUND OF THE INVENTION

Prior art shoelace knot retainers have not been altogether satisfactory. The shoelace knot retainer of this invention is an improvement on prior art devices such as those shown in my U.S. Pat. Nos. 3,106,003 and 3,229,340. The shoelace knot retainers described in those two patents were designed so that an entire knot and ends of the laces are enclosed within the device, and thus, the devices were only suitable for shoes of infants having short laces. Likewise, the shoe tie retainer of U.S. Pat. No. 3,473,198 encloses the knot and ends of the shoelaces and does not accommodate bulkier shoelaces, such as are in common use today.

The bow knot fastener shown in U.S. Pat. No. 3,122,805 has outlets for allowing the ends of the laces to be outside the holder, the bow knot remaining inside the holder, but in that device, the cap of the fastener is loose and screws on to the lower portion. This is not satisfactory since the cap may easily be lost or may be unscrewed by the wearer.

U.S. Pat. No. 3,908,238 also describes a shoelace knot keeper which encloses the knot and ends of the laces. In this device, two sections of a bottom wall are hinged together to allow insertion of the shoelaces into a recess in the bottom wall.

SUMMARY OF THE INVENTION

The improved shoelace knot retainer of the invention comprises hinged parts, a bottom one of which has entry passages for receiving the laces. A top portion closes over the knot, and the top and bottom portions of the retainer both have serrated edges which hold the laces and prevent the knot from being pulled undone.

It is an object of this invention to provide an improved shoelace knot retainer.

It another object of this invention to provide an improved shoelace knot retainer in which the laces cannot readily be pulled undone.

It is a further object of the invention to provide a shoelace knot retainer which cannot be readily be opened by a child.

DESCRIPTION OF THE INVENTION

Figure 1:
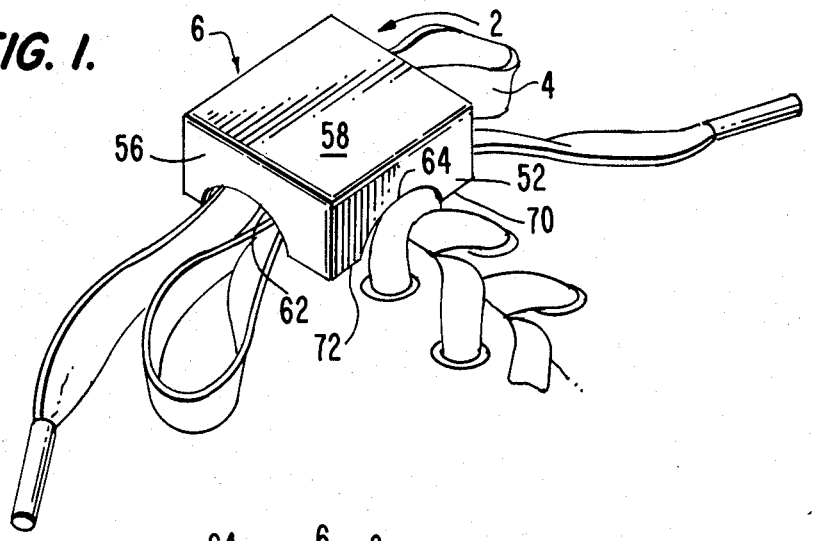
FIG. 1 is a perspective view of a preferred embodiment of the invention of the invention in a closed condition and in use on a shoe.
Figure 2:
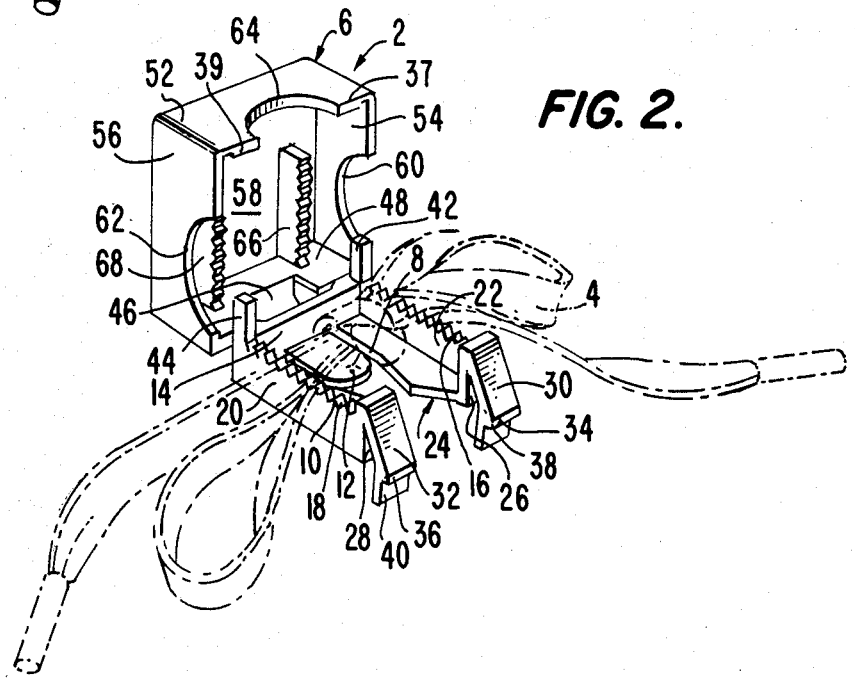
FIG. 2 is a perspective view of the preferred embodiment in an open condition.
Figure 3:
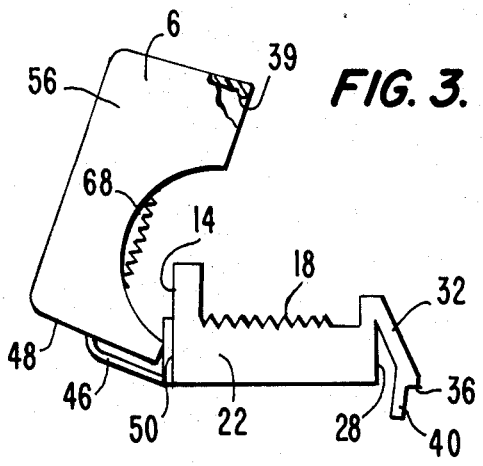
FIG. 3 is a side elevational view of the open preferred embodiment in an open condition.
Figure 4:
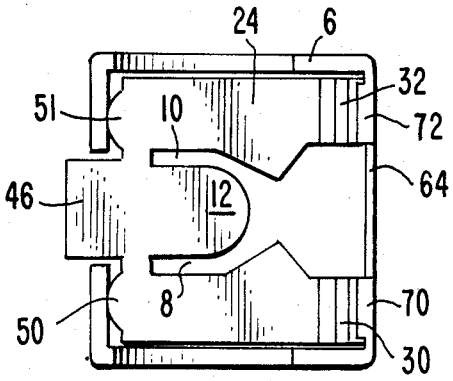
FIG. 4 is a bottom plan view of the preferred embodiment in a closed condition.

Referring now to FIGS. 1–4, in which like numerals represent like parts, FIG. 1 shows a preferred embodiment of a shoelace knot holder 2 of the invention in use on a shoe. Shoelaces 4 are tied in a knot located beneath hinged top 6 of knot holder 2. FIG. 2 is an opened view of knot holder 2 of the invention wherein the shoe laces 4 are shown tied in place in phantom lines. Knot holder 2 may be placed on the shoe and the ends of laces 4 pulled up through shoelace passages 8 and 10 and tied together over tongue 12, or the knot may be tied first and tongue 12 inserted under the knot. Passages 8 and 10 preferably extend to back wall 14 of the knot holder 2, and tongue 12 extends sufficiently far foward that the laces are held in the passages. Tongue 12 preferably does not extend completely to the front of the knot holder and may be omitted in some cases.

After the laces are tied into a bow, the ends of the laces are placed over serrated edges 16 and 18 of side walls 20 and 22 of bottom section 24 of knot holder 2.

Extending forwardly from the tops of front portions 26 and 28 of sidewalls 20 and 22 are latch tabs 30 and 32. The latch tabs have projecting ledges 34 and 36 for engaging latch projections 37 and 39 on the lower edge of top 6 of the device. Tabs 30 and 32 are flexibly connected to portions 26 and 28 to enable them to be released from engagement of top 6 by pressing on the tabs. Lower tab ends 38 and 40 of latch tabs 30 and 32 protrude below top 6 when the device is closed to provide places for manually depressing the tabs to open the device.

Posts 42 and 44 extend upwardly from the rear corners of bottom 24 of the device to lie adjacent rear corners of top 6 when the device is closed. Back wall 48 of top 6 is connected by hinge 46 to back wall 14 of bottom 24. Back wall 14 may be strengthened, as at portion 50, on either side of the connection between hinge portion 46 and wall 14. Strengthening portions 50 also facilitate easy closing of top 6 over bottom 24 by guiding the lower edge of the rear wall of top 6 during closing.

Top 6 has a front wall 52, side walls 54 and 56, and a top surface 58. Side walls 54 and 56 each have a notch, 60 and 62 respectively, open to the bottom edge to allow the shoelaces to rest on top of the shoe outside the knot holder. Notch 64 in front surface 52 allows the knot holder of the invention to fit neatly over the lacing of the shoe. The lower edges of front wall 52, adjacent each side of notch 64, may be coextensive with the width of tabs 30 and 32, the space between tabs 30 and 32 remaining open.

Inside top 6, two ribs 66 and 68 having serrated edges project from surface 58 toward the inside of the knot holder. Serrated ribs 66 and 68 do not extend completely to front wall 52 of top 6, to provide spaces for tabs 30 and 32 when the device is closed. When top 6 is closed over bottom 24, serrated edge 16 lies adjacent serrated rib 66 and serrated edge 18 lies adjacent serrated rib 68. The ribs are slightly horizontally spaced to hold the shoelaces tightly.

As shown in FIG. 2, the tied knot is situated between the serrated ribs. The shoelace on one side is engaged by serrated rib 66 from the top and by serrated edge 16 projecting from the bottom, and exits through notch 60 in side wall 54. On the other side, similarly, the tied shoelace is engaged by serrated rib 68 and by serrated edge 18, and exits through notch 62. If the ends of the shoelaces are pulled, the knot does not become untied because the laces are engaged by the serrated edges as described. The tips of the serrations of the edges are nearly coplanar when the device is closed, but overlap somewhat to grip the shoelace tightly. Posts 42, 44 prevent tied shoelaces 4 from moving over back wall 14 and causing interference when top cover 6 is closed.

FIG. 2 shows the closed device from the bottom, and it can be seen that hinge 46 is connected to bottom 24 adjacent tongue 12 and that the edges of top 6 encircle bottom 24.

The device of the invention is preferably made of plastic. It can be molded from polyethylene, polypropylene, or other plastic known to one skilled in the art. The knot holder of the invention may be decorated in any way to be attractive to the wearer, for example, a decorative decal may be applied to top surface 58.

Variations and modifications may be effected within the scope of the invention as described above, and as defined in the appended claims.

What is claimed is:

1. A shoelace knot retainer comprising a top portion and a bottom portion, said bottom portion comprising two spaced side walls forming an enclosure for a shoelace knot and having an opening between said side walls for receiving shoelaces, said top portion having two ribs, wherein said ribs lie laterally adjacent and parallel to but not engaged with said two side walls when said top portion is engaged over said bottom portion, to secure ends of said shoelace.

2. A knot retainer according to claim 1 wherein said top portion is hingedly connected to said bottom portion.

3. A knot retainer according to claim 2 wherein said bottom portion includes latch means for releasably securing said top portion to said bottom portion when said top portion is engaged over said bottom portion.

4. A knot retainer according to claim 1 wherein said bottom portion includes tongue means extending between said spaced side walls for being received under a shoelace knot.

5. A knot retainer according to claim 1 wherein each of said side walls and said ribs comprises an edge having shoelace gripping means for gripping a shoelace.

6. A knot retainer according to claim 5 wherein said gripping means comprises serrations.

7. A shoelace knot retainer comprising a top portion and a bottom portion, said top portion comprising a top wall and two facing side walls, said bottom portion comprising two spaced side walls forming an enclosure for a shoelace knot and having an opening between said side walls for receiving shoelaces, said top portion having two spaced ribs, said ribs extending from a lower surface of said top portion and said facing side walls being parallel to said ribs, wherein said ribs lie adjacent the two side walls of said bottom portion when said top portion is engaged over said bottom portion to secure ends of said shoelace, and each of said side walls and said ribs comprises an edge having shoelace gripping means for gripping a shoelace.

8. A knot retainer according to claim 7 wherein said top portion includes a front wall extending between said facing side walls, said front wall including latch means for cooperating with latch means on said bottom portion to secure said top portion to said bottom portion.

9. A knot retainer according to claim 8 wherein said facing side walls have notches therein for permitting passage of ends of shoelaces.

10. A shoelace knot retainer comprising a top portion connected to a bottom portion, said bottom portion comprising a base having a pair of side walls forming an enclosure for a shoelace knot, each of said side walls having a top edge, and front and rear walls upstanding from said base, said base further comprising passage means for receiving shoelaces, said passage means communicating with an opening between two front wall portions of said base, each front wall portion being connected to latch means for engaging said top portion when said retainer is in a closed position, wherein said top portion further comprises friction means laterally adjacent and not engaged with said side walls when said knot retainer is in a closed position for engaging said shoelaces to resist movement of said shoelaces when the shoelaces are pulled.

11. A shoelace knot retainer of claim 10 wherein said passage means comprises tongue means for extending beneath a shoelace knot.

12. A shoelace knot retainer of claim 10 further comprising friction means on the top edge of each of said side walls for resisting movement of said shoelaces when the shoelaces are pulled.

13. A shoelace knot retainer of claim 10 further comprising engagement means on said top portion for engaging said latch means.

14. A shoelace knot of retainer of claim 10 further comprising hinge means for connecting said top portion to said bottom portion.

15. A shoelace knot retainer of claim 12 wherein said friction means comprise serrations.

16. A shoelace knot retainer of claim 10 wherein said friction means comprises serrated ribs.

17. A shoelace knot retainer of claim 12 further comprising retention means for preventing rearward movement of the shoelaces.

18. A shoelace knot retainer of claim 17 wherein said retention means comprises at least one post extending upwardly from the bottom portion.

19. A shoelace knot retainer comprising a top portion and a bottom portion, said bottom portion comprising two spaced side walls and having an opening between said side walls for receiving shoelaces, said top portion having two spaced ribs which lie adjacent said two side walls when said top portion is engaged over said bottom portion to secure ends of said shoelace, said top portion further comprising a top wall and two facing side walls, said ribs extending from a lower surface of said top portion and said facing side walls being parallel to said ribs.

* * * * *